US005408727A

United States Patent [19]

Pinto et al.

[11] Patent Number: 5,408,727

[45] Date of Patent: Apr. 25, 1995

[54] METHOD AND APPARATUS FOR MIXING AND OPENING PNEUMATICALLY SUPPLIED FIBER MATERIAL

[75] Inventors: Akiva Pinto, Duesseldorff-Wittlaer; Guenter Lucassen, Haltern; Reinhard Schmidt, Gescher, all of Germany

[73] Assignee: Hergeth Hollingsworth GmbH, Dulelmen, Germany

[21] Appl. No.: 136,352

[22] Filed: Oct. 14, 1993

Related U.S. Application Data

[63] Continuation-in-part of Ser. No. 30,434, Aug. 29, 1991, Pat. No. 5,337,455.

[30] Foreign Application Priority Data

Oct. 16, 1992 [DE] Germany ..... 42 35 022.0

[51] Int. Cl.[6] ..... D01G 23/00; D01G 9/08; D01G 13/00

[52] U.S. Cl. ..... 19/105; 19/97.5

[58] Field of Search ..... 19/97.5, 105, 205, 108, 19/65 R

[56] References Cited

U.S. PATENT DOCUMENTS

| | | | |
|---|---|---|---|
| 989,545 | 4/1911 | Hampson . | |
| 3,062,393 | 11/1962 | Bond | 19/105 X |
| 4,528,723 | 7/1985 | Hergeth et al. | 19/97.5 X |
| 4,586,218 | 5/1986 | Pinto | 19/105 |
| 4,656,694 | 4/1987 | Windges | 19/105 |
| 4,697,309 | 10/1987 | Rudolph | 19/105 |
| 4,811,463 | 3/1989 | Leifeld | 19/105 |
| 4,970,759 | 11/1990 | Roberson | 19/105 |
| 5,083,345 | 1/1992 | Leifeld | 19/105 |
| 5,218,741 | 6/1993 | Leifeld et al. | 19/105 X |
| 5,226,213 | 7/1993 | Lewis et al. | 19/205 X |

FOREIGN PATENT DOCUMENTS

| | | | |
|---|---|---|---|
| 1975124U | 9/1967 | Germany . | |
| 3530327C2 | 6/1987 | Germany . | |
| 1133883 | 11/1968 | United Kingdom | 19/105 |
| 2228496 | 8/1990 | United Kingdom | 19/105 |

*Primary Examiner*—John J. Calvert

*Attorney, Agent, or Firm*—Leatherwood Walker Todd and Mann

[57] ABSTRACT

In a mixing and opening device for pneumatically supplied flocculent fiber material, wherein fiber material is fed, by use of transport air and through a supply conduit, to a blow-in chute section of a hopper, wherein said blow-in chute section comprises a screen means for separating the fiber material from the transport air, and an air collecting chamber arranged behind said screen means for discharge of the transport air, and wherein, on the lower end of said hopper, the fiber material layered in said hopper can be fed via an intake means to an opening means, it is provided that the intake means comprises two intake rollers of different sizes.

28 Claims, 2 Drawing Sheets

METHOD AND APPARATUS FOR MIXING AND OPENING PNEUMATICALLY SUPPLIED FIBER MATERIAL

This application is a continuation-in-part of application Ser. No. 08/030,434, filed Aug. 29, 1991, now U.S. Pat. No. 5,337,455.

BACKGROUND OF THE INVENTION

The invention is directed to a mixing and opening device and method for the mixing and opening of pneumatically supplied flocculent fiber material.

German Offenlegungschrift DE 39 04 853 A1 discloses a device for the pneumatic feeding of fiber material to a hopper, wherein the fiber material is supplied by transport air via a feed tube, and a trunk has one of its walls provided with passages for the discharge of the transport air, the passages being joined by a closed collecting chamber having a discharge means for the transport air. The air collecting chamber, arranged on one side of the hopper, can be divided into sections, and these sections of the air collecting chamber are adapted to be closed alternately.

In the above device for the pneumatic feeding of fiber material to a hopper, the fibers are laid in substantially horizontal layers on top of each other. At the lower end of the hopper the fibers are further transported or processed in the order in which they have been laid.

It is an object of the present invention to provide a mixing and opening device and method wherein the process of feeding fibers through a hopper is used for an improved mixing of the supplied fibers.

SUMMARY OF THE INVENTION

According to the invention, in an advantageous manner, the hopper in the region of a blow-in chute section is provided, on both sides of the hopper, with a respective screen wall and a respective air collecting chamber arranged behind the screen wall. The air collecting chamber and the screen wall extend substantially across the width of the hopper, and the upper edges of the screen walls extend at different heights relative to each other. In this manner, it is achieved that, corresponding to the air stream, the fiber material supplied by the transport air will be laid differently with respect to the width and the depth of the hopper. Thus, the layers generated will not be substantially horizontal anymore but will be inclined about two axes relative to the horizontal line. These layers will then be horizontally reduced by an intake and opening device, whereby fiber material laid at the same time will be seized by the intake and opening device at different times.

In this manner, mixing of the supplied fiber material can take place in the hopper.

Further, it is provided according to the invention that the intake device comprises two intake rollers of different sizes. By using intake rollers of different sizes, the arrangement of layers in the hopper can be angled so that the different layers of fiber material are reduced simultaneously. The ratio between the sizes of the intake rollers is preferably about 1:1.5 to about 1:2.5. This leads to improved mixing of the supplied fiber material.

The combination of a larger intake roller with a smaller intake roller offers the additional advantage that a larger hopper, or trunk, depth can be used. Further, the provision of the differently sized intake rollers has the advantage that, when the hopper is empty or nearly empty, no fiber flocks passing through the intake rollers can directly reach the opening roller, which is the case even with larger trunk depths.

Preferably, the large intake roller is arranged in the hopper in such a manner that the intake roller is located adjacent to the trunk wall on one side while an intake passage for the layers remains on the opposite side. Since the vertical movement of the layers is higher in the region of the hopper and above the hopper, there is obtained an obliquely angled infeed of the layers. The already existing oblique orientation of the layers is intensified and results in a considerable improvement of the mixing of the fiber material.

The mixing effect can be additionally increased when the intake device of the invention is combined with the blow-in chute section of the invention, because the mixing effect caused by the blow-in chute section and the mixing effect caused by the intake device will complement each other and result in an intensified mixing of the fiber material.

Preferably, the air collecting chambers are arranged on both sides of the hopper and parallel thereto, and can be closed alternately. The temporary closing of the air collecting chambers prevents clogging of the screen walls.

Preferably, the screen walls have surfaces of different sizes. By use of these differently-sized screen surfaces on both sides of the hopper, the effect of laying the fiber material differently over the width and the depth of the hopper is enhanced.

The infeed of the fiber material by transport air is performed horizontally from an end side of the hopper, and preferably by an elbow arranged in the horizontal plane. Such an infeeding of the fiber material leads to generation of turbulences in the region of the blow-in chute section of the hopper.

These turbulences act against the danger of possible clogging of the screen walls and also effect thorough dust extraction from the supplied fiber material.

In an advantageous embodiment, it is provided that at least one screen wall has an upper edge extending at an oblique angle to the horizontal line. This oblique angle provides for a surface reduction of the screen area and a guidance of the transport air stream to the effect that, viewed over the cross section of the trunk, fiber material is laid in larger or smaller quantities according to the screen surface so that twice inclined layers are generated.

It can also be provided that both screen walls are kept open over their full surfaces across the width of the hopper and that at least one screen wall surface can be partially closed to the stream of air by means of an adjustable slider. Such an adjustable slider can be employed for influencing the desired effect of the twice-inclined formation of layers, which can be of importance, for example, when using different fiber materials.

An embodiment of the invention will be described in greater detail below, with reference to the accompanying drawings.

BRIEF DESCRIPTION OF THE DRAWINGS

The foregoing, as well as other objects of the present invention, will be more apparent from the following detailed description of the preferred embodiment of the invention, when taken together with the accompanying drawings, in which.

DESCRIPTION OF THE PREFERRED EMBODIMENT

Figure 1:
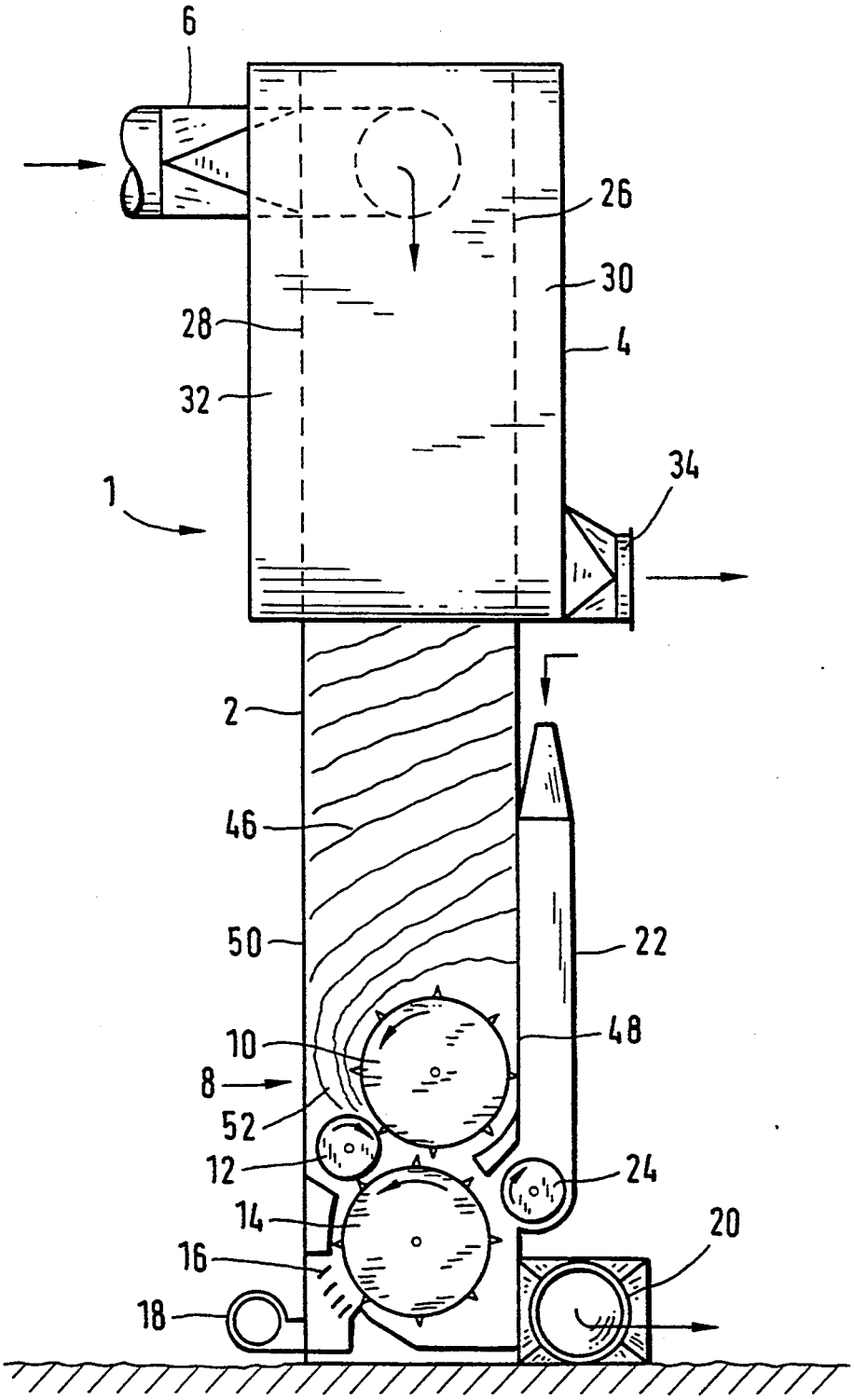
FIG. 1 shows a schematic cross section of the mixing and opening device.

Referring to the drawings in detail, wherein like reference characters represent like elements throughout the various views, FIG. 1 shows a mixing and opening device 1 comprising a trunk, or hopper 2 having an end side 3 with an upper blow-in chute section 4 which, by use of transport air, is supplied with fiber material through a supply conduit 6.

On the lower end of the hopper 2, there is provided an intake device, generally 8, comprising two intake rollers 10,12 of different sizes, and an opening device comprising an opening roller 14. Opening roller 14 cooperates with a grate 16 where dust, dirt and trash particles can be separated and removed through a suction conduit 18. At the lower end of hopper 2, the fiber flow is supplied to the next fiber processing means via a transport conduit 20. The mixing and opening device 1 can be additionally provided with a waste material supply chute 22, arranged in parallel to the hopper 2, for feeding waste material to opening roller 14 through an intake roller 24 and a trough feeder.

Figure 2:
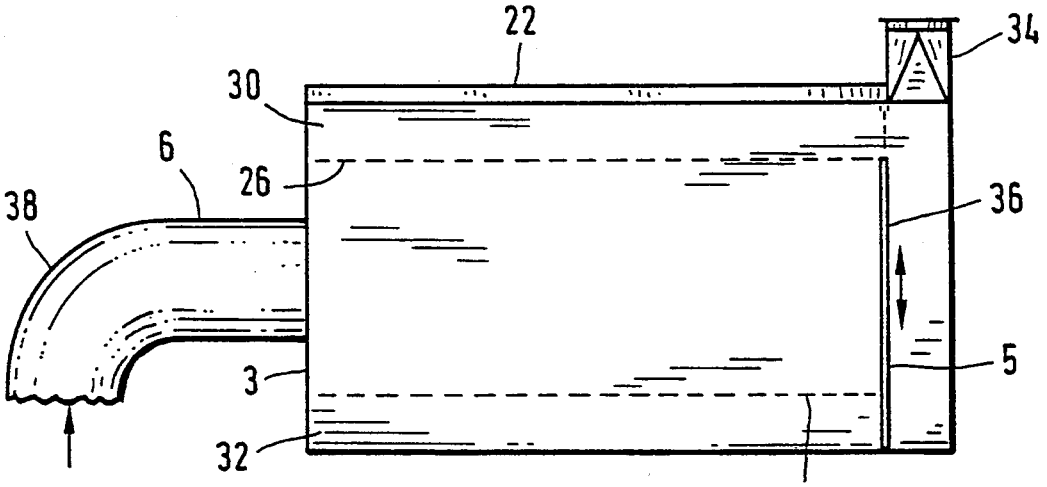
FIG. 2 shows a schematic plan view of the mixing and opening device according to FIG. 1.

In the region of the blow-in chute section 4, the hopper 2 has two of its sides provided with screen walls 26,28 arranged across the width of hopper 2 and parallel to the wider sides thereof. On these screen walls 26,28, the fiber material is separated from the transport air stream. Behind the screen walls 26,28, the transport air enters into a respective air collecting chamber 30,32. As best shown in FIG. 2, each of the air collecting chambers 30,32 is connected to an air discharge conduit 34, and a slider 36 can alternately block the one or the other air collecting chamber 30,32 so that the air stream through a respective one of the two screen walls 26,28 can be temporarily interrupted. Thereby, adhering fiber material can drop down and clogging of the screen walls 26,28 can be prevented.

As also shown in FIG. 2, supply conduit 6 comprises an elbow 38 curved in a horizontal plane for generating turbulences of the fiber material blown into blow-in chute section 4. These turbulences lead to thorough dust extraction from fiber material, with the dust particles being discharged along with the transport air.

Figure 3:
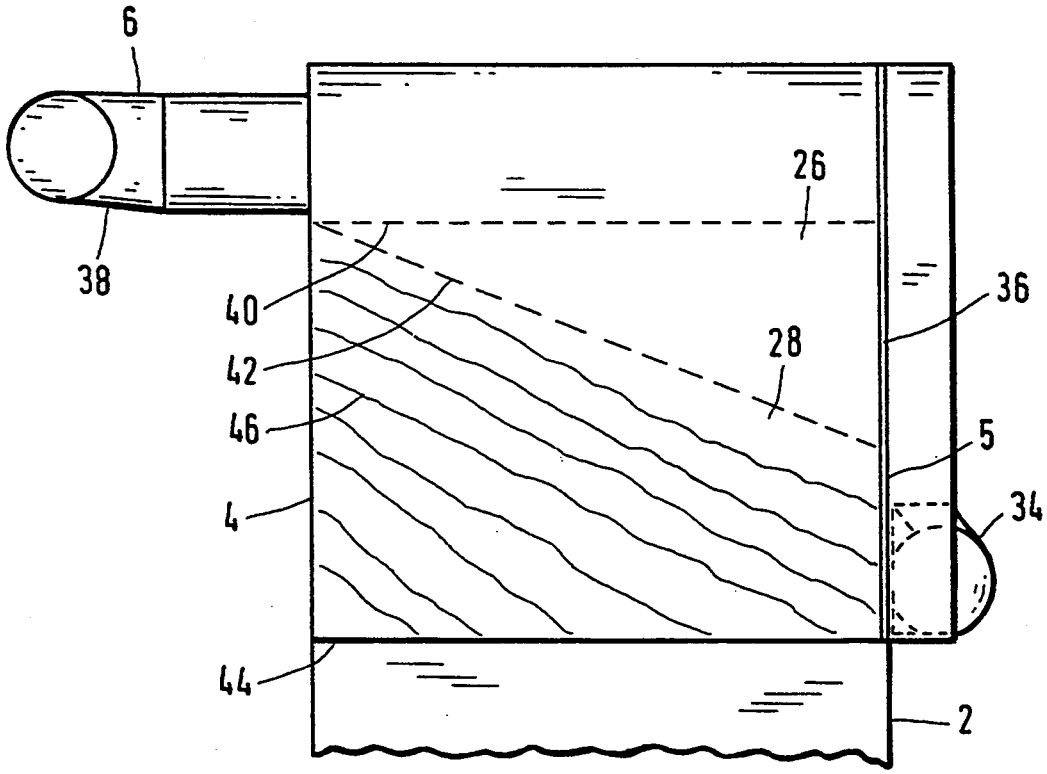
FIG. 3 shows a front view of the blow-in chute section of the mixing and opening device.

In the embodiment of FIG. 3, the upper edge 40 of the screen wall 26 arranged to the rear in FIG. 3 extends horizontally, while the upper edge 42 of the screen wall 28 arranged to the front in FIG. 3 is sloping obliquely down to about half the height of the screen walls 26,28 on the end side 5 of hopper 2 opposite supply conduit 6. The lower edges 44 of both of the screen walls 26,28 end flush with the lower edge of air discharge conduit 34 or blow-in chute section 4. The screen walls 26,28 extend substantially across the width of hopper 2.

The upper edges 40,42 and the lower edges 44 can also have another orientation and can extend in opposite directions. It is essential that the air stream in the blow-in chute section 4 is influenced in such a manner that the layer-wise laying of the fiber material is performed with at least one, but preferably with two inclinations, as is shown in FIGS. 1 and 3.

The arrangement of layers 46 is inclined about a horizontal axis extending in parallel to the width of trunk 2 as well as about a horizontal axis extending transversely to the width of the trunk.

According to FIG. 1, the twice inclined arrangement of layers 46 is successively fed to the intake device 8 which horizontally seizes the fiber material for feeding it to the opening roller 14 at an angle of about 45 degrees from vertical.

The intake device 8 comprises two intake rollers 10,12 having different diameters, working preferably at identical circumferential speeds. The combination of a large intake roller with a small intake roller intensifies the oblique orientation of the arrangement of layers 46 and has the effect that the fiber reduction is performed on the fiber material from different layers, thus providing for intensive mixing of the fiber material.

Further, the arrangement of the intake rollers 10,12 allows for a better clamping action on the layers 46 supplied to opening roller 14. This is particularly advantageous when the filling level in hopper 2 is low.

In FIGS. 1 and 3, each of the individual lines indicating the layers 46 represents a layer of the flocculent fiber material laid at a respective time.

In the embodiment according to FIG. 1, the intake roller 10 and the opening roller 14 have substantially the same size. A connecting line between intake roller 10 and opening roller 14 preferably extends at an angle of about ±5 degrees from vertical. The ratio between the sizes of intake roller 10 and opening roller 14 is about 0.5 to about 1.1, and preferably 0.8 to 1.0. The diameter of intake roller 10 is larger than half the width of the trunk and at one portion extends up to one trunk wall 48. On the portion of intake roller 10 which is facing towards the layers 46, the roller rotates in a direction leading away from trunk wall 48, with an intermediate space 52 remaining between the intake roller 10 and the other trunk wall 50, in which the layers 46 are fed to the intake roller 12 having the smaller diameter. The smaller intake roller 12 rotates in the opposite sense to intake roller 10 so that the fiber material can be supplied to opening roller 14 between these two intake rollers 10,12. A connecting line between the axes of the intake rollers 10,12 extends at an angle of about 40 degrees to 50 degrees from vertical.

The ratio between the diameters of the intake rollers in FIG. 1 is about 1:2. The ratio between the diameter of intake roller 10 to the trunk depth is about 0.6 to 0.8; in the embodiment of FIG. 1, this ratio is about 0.7.

While a preferred embodiment of the invention has been described using specific terms, such description is for present illustrative purposes only, and it is to be understood that changes and variations to such embodiment, including but not limited to the substitution of equivalent features or parts, and the reversal of various features thereof, may be practiced by those of ordinary skill in the art, without departing from the spirit or scope of the following claims.

What is claimed is:

1. A mixing and opening device for flocculent fiber material carried by transport air, comprising:

a supply conduit for receiving the flocculent fiber carried by the transport air;

a hopper, said hopper defining a first wall and a second wall spaced apart from said first wall and a blow-in chute; said supply conduit being connected to said blow-in chute for delivering the flocculent fiber thereto;

said blow-in chute including a first screen wall extending proximate to and substantially across the width of said first wall of said hopper and a second screen wall extending proximate to and substantially across the width of said second wall of said hopper; said first and second screen walls being for separating the flocculent fiber material from the transport air and for creating layers of such separated fiber;

a first air collecting chamber provided between said first screen wall and said first wall of said hopper and a second air collecting chamber provided between said second screen wall and said second wall of said hopper, each of said first and second air collecting chambers being for receipt and discharge of the transport air;

layer release means associated with said hopper for providing release of layers of fibers from at least one of said first and second screen walls;

intake means associated with said hopper positioned below said first and second screen walls for receiving the layers of fibers collected by said first and second screen walls; and opening rollers in communication with said intake means for receiving and opening fibers from the intake means.

2. The mixing and opening device according to claim 1, wherein the intake means comprises two intake rollers of different sizes.

3. A mixing and opening device according to claim 2, wherein the intake rollers have the same circumferential speed.

4. The mixing and opening device according to claim 1, wherein said first and second air collecting chambers can be alternately closed.

5. The mixing and opening device according to claim 1, wherein said first and second screen walls are of different sizes.

6. The mixing and opening device according to claim 1, wherein said hopper includes a third wall; said third wall defining an inlet in communication with said supply conduit for infeeding of the fibers to said hopper.

7. The mixing and opening device according to claim 1, further comprising said supply conduit having an elbow portion curved in a substantially horizontal plane for feeding fibers to said hopper.

8. The mixing and opening device according to claim 1, wherein said first screen wall defines a first lower edge and said second screen wall defines a second lower edge and wherein at least one of said first and second lower edges extends lower than the other.

9. The mixing and opening device according to claim 1, further comprising a shiftable slider for selectively closing at least one of said first and second air collecting chambers.

10. The mixing and opening device according to claim 1, further comprising a waste material supply chute associated with said hopper and in communication with said opening means; and said waste material supply chute including a waste material intake roller for feeding reusable waste material to said opening means.

11. The mixing and opening device according to claim 1, wherein said intake means includes an intake roller having a diameter larger than one-half the width of the portion of said hopper adjacent to said intake roller.

12. The mixing and opening device according to claim 1, wherein said opening means includes an opening roller and wherein said intake means includes at least one intake roller positioned such that a line connecting the axes of said opening roller and said intake roller extends at an angle within 5 degrees from vertical.

13. The mixing and opening device according to claim 1, wherein a line connecting the axes of said two intake rollers extends at an angle between 40 degrees to 50 degrees from vertical.

14. The mixing and opening device according to claim 1, wherein said intake means includes at least one intake roller and wherein said opening means includes at least one opening roller, and wherein the ratio of diameters of said intake roller and said opening roller is between 0.5 to 1.1.

15. The mixing and opening device according to claim 1, wherein said first screen wall defines a first upper edge and said second screen wall defines a second upper edge; said first and second upper edges extending to differing heights with respect to one another.

16. The mixing and opening device according to claim 15, wherein at least one of said first and second upper edges extends obliquely with respect to a horizontal line.

17. The mixing and opening device according to claim 15, wherein said first screen wall is open across the complete width of said blow-in chute; and said second upper edge of said second screen wall slopes downwardly to approximately one-half the height of said first screen wall.

18. A mixing and opening device for flocculent fiber material carried by transport air, comprising:

a supply conduit for receiving the flocculent fiber carried by the transport air;

a hopper, said hopper defining a first wall and a second wall spaced apart from said first wall and a blow-in chute; said supply conduit being connected to said blow-in chute for delivering the flocculent fiber thereto;

layer forming means associated with said hopper for separating the flocculent fibers from the transport air and for forming layers of the flocculent fibers separated from the transport air;

at least one air collecting chamber associated with said layer forming means for discharge of the transport air;

said layer forming means and said hopper being configured for collecting and accumulating in said hopper layers of the fibers separated and layered by said layer forming means;

first and second intake rollers carried for rotation in said hopper and for receiving the fibers separated by said layer forming means; and opening rollers in communication with at least one of said first and second intake rollers for receiving and opening fibers therefrom.

19. The mixing and opening device according to claim 18, wherein said layer forming means includes screen means having a first screen wall extending proximate to and substantially across the width of said first wall of said hopper and a second screen wall extending proximate to and substantially across the width of said second wall of said hopper; said first and second screen walls being for separating the flocculent material from the transport air and for creating layers of such separated fibers; said first screen wall defining a first upper edge and said second screen wall defining a second upper edge; said first and second upper edges extending at different heights with respect to one another;

said at least one air collecting chamber including a first air collecting chamber provided between said first screen wall and said first wall of said hopper and a second air collecting chamber provided between said second screen wall and said second wall of said hopper, each of said first and second air collecting chambers being for receipt and discharge of transport air.

20. The mixing and opening device according to claim 18, wherein at least one of said first and second intake rollers has a diameter larger than half the width of a portion of said hopper adjacent to said at least one of said first and second intake rollers.

21. The mixing and opening device according to claim 18, wherein said opening means includes at least one opening roller and wherein a line connecting the axes of said at least one opening roller and at least one of said first and second intake rollers extends at within an angle of approximately 5 degrees from vertical.

22. The mixing and opening device according to claim 18, wherein a line connecting the axes of said first and second intake rollers extends at an angle between 40 degrees to 50 degrees from vertical.

23. The mixing and opening device according to claim 18, wherein said opening means includes at least one opening roller and wherein the ratio of diameters between said at least one opening roller and at least one of said first and second intake rollers is between 0.5 and 1.1.

24. The mixing and opening device according to claim 18, wherein said first and second intake rollers operate at substantially the same circumferential speed.

25. The mixing and opening device according to claim 18, wherein said first and second intake rollers are of different diameters, respectively.

26. A method for the mixing and opening of pneumatically supplied flocculent material, comprising:

blowing the fiber material into a hopper having a blow-in chute section;

separating the fibers from the transport air;

placing the fibers into the hopper in a layered arrangement;

separating the transport air from the fiber material on different levels of the blow-in chute section, both with respect to the width direction of the hopper and with respect to the depth direction of the hopper; and layering the fiber material in the hopper such that the fiber layers are inclined about two axes relative to a horizontal plane.

27. The method according to claim 26, including delivering the fiber layers at an angle between 40 degrees and 50 degrees from vertical to an opening means.

28. The method according to claim 26, further comprising generating additional inclination to the fiber layers through use of at least two intake rollers of different sizes.

* * * * *